US007020581B2

(12) United States Patent
Dittberner

(10) Patent No.: US 7,020,581 B2
(45) Date of Patent: Mar. 28, 2006

(54) MEDICAL HEARING AID ANALYSIS SYSTEM

(75) Inventor: Andrew B. Dittberner, Antioch, IL (US)

(73) Assignee: Medacoustics Research & Technology, Forest Lake, MN (US)

( * ) Notice: Subject to any disclaimer, the term of this patent is extended or adjusted under 35 U.S.C. 154(b) by 81 days.

(21) Appl. No.: 10/689,569

(22) Filed: Oct. 20, 2003

(65) Prior Publication Data

US 2004/0158431 A1 Aug. 12, 2004

Related U.S. Application Data

(60) Provisional application No. 60/419,676, filed on Oct. 18, 2002.

(51) Int. Cl.
*G06F 15/00* (2006.01)

(52) U.S. Cl. ..... 702/183

(58) Field of Classification Search ..... 381/23.1, 381/55, 58, 60, 312; 702/33, 45, 48, 54, 702/81, 83, 84, 108, 113, 116, 120, 127, 182, 702/183, 188, 189, 190
See application file for complete search history.

(56) References Cited

U.S. PATENT DOCUMENTS 4,548,082 A * 10/1985 Engebretson et al. ..... 73/585
RE34,961 E 6/1995 Widin et al.
5,703,797 A 12/1997 Russell
5,729,658 A 3/1998 Hou et al.
5,870,481 A 2/1999 Dymond et al.
5,923,764 A * 7/1999 Shennib ..... 381/60
5,944,672 A * 8/1999 Kim et al. ..... 600/559
6,118,877 A * 9/2000 Lindemann et al. ..... 381/60
6,366,863 B1 * 4/2002 Bye et al. ..... 702/57

(Continued)

FOREIGN PATENT DOCUMENTS

WO WO 99/31937 12/1998

OTHER PUBLICATIONS

Chung,D; Doh, W; Youn, D, Choi, J;Woo, H; Kim, D; Kim, W; "Hearing Impairment Simulation For The Performance Evaluation Of Hearing Aid System"; 18th Annual Int'nl Conf. IEEE Engineering in Medicine and Biology Society; vol. 1; Oct. 31-Nov. 3, 1996; pp 415-416.*

(Continued)

*Primary Examiner*—Bryan Bui
*Assistant Examiner*—Douglas N. Washburn
(74) *Attorney, Agent, or Firm*—Patterson, Thuente, Skaar & Christensen, P.A.

(57) ABSTRACT

A hearing aid analysis system for objective determination of speech perception enhancement for a hearing aid under test uses prerecorded speech and a computer system that includes a speech recognition program. Hearing aid analysis circuitry is provided to receive a plurality of signals representing signals generated by speech sounds routed through different acoustic paths, and filter circuitry to simulate a hearing loss. The hearing aid is interfaced with the source of prerecorded speech sounds and the analysis circuitry. The computer system includes a control program that presents the prerecorded speech to the analysis circuitry to produce a degraded signal routed through the filter circuitry and a processed signal routed through the hearing aid and the filter circuitry. The speech recognition program then compares speech recognition from the degraded signal with speech recognition from the processed signal to determine an objective indication of speech perception enhancement forte hearing aid.

20 Claims, 7 Drawing Sheets

U.S. PATENT DOCUMENTS

| | | | | |
|---|---|---|---|---|
| 6,647,345 | B1 * | 11/2003 | Bye et al. | 702/57 |
| 6,674,862 | B1 * | 1/2004 | Magilen | 381/60 |
| 6,792,114 | B1 * | 9/2004 | Kates et al. | 381/60 |
| 2001/0040969 | A1 * | 11/2001 | Revit et al. | 381/60 |
| 2002/0146137 | A1 * | 10/2002 | Kuhnel et al. | 381/60 |
| 2003/0161482 | A1 * | 8/2003 | Miller et al. | 381/60 |
| 2004/0028250 | A1 * | 2/2004 | Shim | 381/312 |
| 2004/0047474 | A1 * | 3/2004 | Vries et al. | 381/60 |

OTHER PUBLICATIONS

Jamieson, D; Schneider, T; "Electroacoustic Evaluation of Assistive Hearing Devices"; IEEE Engineering in Medicine and Biology; vol. 13, issue 2; Apr.-May 1994; pp 249-254.*

Jamieson, D; Raferty, E; "A General Purpose Hearing Aid Prescription, Simulation and Testing System";Int'l Conf. on Acoustics, Speech and Signal Processing; May 23-26, 1989; vol. 3; pp 1989-1992.*

Ravn, G; Madsen, T; "Hearing Aids-Acoustic and EMC Test Methods/Standards"; 18th Annual Int'nl Conf. IEEE Engineering in Medicine and Biology Society; vol. 5; Oct. 31-Nov. 3, 1996; pp 2196-2197.*

Schneider, T; Jamieson, D; "Electroacoustic Characterization of Hearing Aids: A System Identification Approach"; ;Int'l Conf. on Acoustics, Speech and Signal Processing; May 9-12, 1995; vol. 5; pp 3523-3526.*

Website print-out: *UCL Enhance Home Page*, UCL Enhance, Mark Huckvale University College, London, U. K., 3 pgs.; Copyright 2000.

*Telecoils in Hearing Aids in the USA*, Hard of Hearing Advocates, Framingham, MA, Spring Edition, 4 pgs.; Aug. 29, 2002.

*Speech Segregation Based on Sound Localization*, N. Roman, D. Wang, G. Brown, Technical Report Ohio State University-CISRC, Department of Computer and Information Science, 26 pgs.; Jun. 2002.

Website print-out: *PMC/BRYSTON GET HIP*, Bryston News, Bryston Limited, Canada, 3 pgs.; vol. 5, Issue 5, Sep. 2001.

*FONIX® 6500-CX Quick Reference Guide to Testing Hearing Aids with the FONIX 6500-CX*, Frye Electronics, Inc., Tigard, Oregon, 46 pgs.; Copyright 1997.

Website print-out: *Aurical™*, Instrumentation Associates, Inc., Broomall, Pennsylvania, 2 pgs.; Copyright 1999.

* cited by examiner

MEDICAL HEARING AID ANALYSIS SYSTEM

RELATED APPLICATION

The present invention claims priority to U.S. Provisional Patent Application No. 60/419,676, filed Oct. 18, 2002, entitled "Medical Hearing Aid Analysis System," the contents of which is hereby incorporated by reference.

FIELD OF THE INVENTION

The invention relates to systems for testing the effectiveness of hearing aids. More particularly, the invention relates to the holistic testing of hearing aid function for improving quality of voice perception.

BACKGROUND OF THE INVENTION

Currently, existing hearing aid analysis technologies are designed to assess the performance of individual electroacoustical components found in or associated with hearing aids. This technology verifies whether the individual electroacoustical components are functioning properly and whether the components maintain their performance within the tolerance standards promulgated by the American National Standard Institute (ANSI). In these testing strategies, simple and highly predictable signals are typically used to evaluate the functioning of the components. For example, sine wave tones are typically used. However, with advances in digital technology and the utilization of sophisticated signal processing strategies, the use of simple predictable signals may not be very closely related to the effect upon sounds which is ultimately perceived by the hearing aid wearer (e.g., speech or music).

Typically, for the successful adaptation of a hearing aid to a given patient, a number of steps are taken. Initially, as indicated above, the hearing aid itself is evaluated to ensure that all of the components are functioning properly. Current technology prescribes a battery of tests to systematically analyze the electroacoustical components of the hearing aid. For example, the microphone and receiver are tested in terms of their frequency response and to determine the level of distortion introduced into test signals. Modem hearing aids also include amplifiers, telecoils, and many other electronic components. Telecoils are inductive devices which are used to receive signals that are not acoustic in origin. Telecoils respond to an electromagnetic field created by, for example, a telephone handset. By the use of a simple switch, the hearing aid wearer is able to activate the telecoils and deactivate the microphone, thereby eliminating problems of feedback, distortion and background noise. The signal from the telephone is transmitted directly, electromagnetically to the hearing aid receiver and an amplified clear signal is provided to the hearing aid wearer. Telecoils can also be used to receive signals created by loop systems imbedded in many public facilities such as churches and theaters. Unfortunately, these tests do not determine whether more sophisticated technology such as dynamic compression, advance noise reduction strategies, and speech cue enhancement are functioning properly.

After the electroacoustical components are tested, the hearing aid is programmed based on manufacturer specifications and a fitting strategy adapted to the needs of the individual hearing aid wearer. Previously gathered audiometric data is used to estimate amplification levels as a function of frequency to make a desired signal audible. In addition, compression levels are set, based again on audiometric data, to ensure that the desired signal remains at a comfortable amplification level.

Next, the fitting strategy is verified using what are referred to as "real ear methods." A real ear method involves placing a probe tube microphone inside the ear canal of the user while the hearing aid is in place. The test operator then presents sinusoidal signal tones through a speaker, the tones are amplified by the hearing aid and the amplified result is sensed by the probe tube microphone. This confirms that selected frequency ranges are appropriately amplified as desired. In this procedure, no real world signals such as speech are introduced or tested, therefore, no information has been gathered to verify whether some of the more advanced processing techniques of the modern hearing aids are functioning adequately.

Finally, the hearing aid system is put through a validation process. The aim of the validation process is to ensure that the hearing aid components, the programming based on audiometric data, and the verification based on real ear measurements are sufficient to allow the hearing aid wearer to function adequately. Unfortunately, in many cases, this last stage of testing is not completed. Some individuals, particularly younger children, older adults and cognitively impaired individuals, may not be able to adequately cooperate to complete the testing procedure. These validation testing procedures typically include a process in which words or sentences are presented at a normal conversational level in a quiet environment and the hearing aid wearer is requested to repeat the words or sentences played. In some situations, the test is repeated in an environment that includes significant background noise. As can be imagined in this situation, careful calibration of the test signals, whether words or sentences, is very important to the success of the test. Calibration is a continuing and common problem in this field.

While the preferred embodiment of the present invention has been described and tested with respect to speech recognition for the English language, it will be recognized that the present invention is equally applicable to speech recognition in other languages. Given the phonetic, timing and tonal differences of different languages, the present invention may also be utilized to identify hearing aids that are better suited for particular languages based on speech recognition in that language. Similarly, the present invention can not only be used to differentiate the response of different hearing aids, but can also be utilized to evaluate and adjust a single hearing aid for a particular patient in terms of programmable parameters and setting adjustments for that hearing aid.

Examples of current hearing aid testing equipment include the Fonix® line of hearing aid analyzers, the Aurical™ audiodiagnostic and fitting system and the MS40 Hearing Aid Analyzer. U.S. Pat. No. 5,703,797 describes the use of a digital Fourier transform to analyze warbled tones supplied to a hearing aid for test purposes. U.S. Pat. No. 5,729,658 describes a hearing aid evaluation system that generates multiple computer models of processed signal articulation to aid in evaluation and selection of a hearing aid for a given patient. Automated system for hearing aid prescription and patient analysis are described in U.S. Pat. Nos. 5,923,764 and 6,366,863.

PCT Publ. No. WO 99/31937 describes a hearing aid adjustment system that causes a list of pre-selected words to be played for a user with an electronically programmable hearing aid. The user repeats what has been heard to a speech recognition program that has been pre-trained by the hearing aid user. The computer executing the speech recognition program determines which words are correctly identified in response to the spoken words by the hearing aid user. An imputed inverse transform is computed based on pre-knowledge of the frequency content and time and amplitude variation of the pre-selected words. The computed inverse transform is then used to electronically adjust the programmable hearing aid.

While these approaches are adequate for simple testing and adjustment of hearing aids, the hearing aid arts would benefit greatly from the availability of an objective testing technique to improve the evaluation of the effectiveness of hearing aids and particularly the effectiveness of advanced hearing aid technology such as dynamic compression, advanced noise reduction and speech cue enhancement.

SUMMARY OF THE INVENTION

The present invention is a hearing aid analysis system that objectively evaluates the effectiveness of advanced hearing aid technologies. The hearing aid analysis system objectively measures the effectiveness of advanced hearing aid technologies by comparing the results of computer speech recognition software obtained from enhanced and unenhanced speech. The system first presents an original unprocessed speech signal to the speech recognition software as a control measure. Next the system presents a speech signal that has been processed through the hearing aid and then through hearing loss filtering to simulate as closely as possible the effect of the hearing aid plus patient system. Last, the system presents a speech signal that has been degraded by the same hearing loss filtering to the speech recognition software. Recognition rate software then compares the speech recognition rate of the two different signals. Based on this comparison the system creates an objective indication of benefit to be obtained from the hearing aid under test can be made in relation to the control measure.

The hearing aid analysis system of the invention generally preferably includes a series of functions. Initially, the system applies an analysis of the individual electro acoustical components of a hearing aid. This analysis essentially replicates the limited form of objective analysis that is presently performed by the existing technologies. Second, the hearing aid analysis system performs an analysis of speech enhancement strategies used in the hearing aid under test. Third, the system employs an analysis of the noise reduction strategies used in the subject hearing aid. This step includes filtering and periodic analysis techniques as well as the evaluation by directional microphone systems. Fourth, the system includes programming and analysis of the hearing aid systems including programming of individual programs if the hearing aid is multi programmable. This programming and analysis is performed in a test box but does not make use of directional microphones. Fifth, the system performs an analysis of the hearing aid system using real ear measures and also utilizing sound field arrangements. Finally, the system creates a prediction of performance of the hearing aid, when used by a user, based on the user's audiometric data and psychoacoustic theory regarding hearing loss and its effect on speech perception.

All of the new testing procedures utilized in the invention are accomplished without the need for any human user input or interaction. This allows for successful application in the case of young children, elderly adults, or others that may be incompetent to interact with the system requiring their subjective input.

The above summary of the present invention is not intended to describe each illustrated embodiment or every implementation of the present invention. The following figures and detailed description more particularly exemplify the embodiments of the present invention.

BRIEF DESCRIPTIONS OF THE DRAWINGS

The present invention may be more completely understood in consideration of the following detailed description of various embodiments of the invention in connection with the accompanying drawings, in which.

Figure 1:
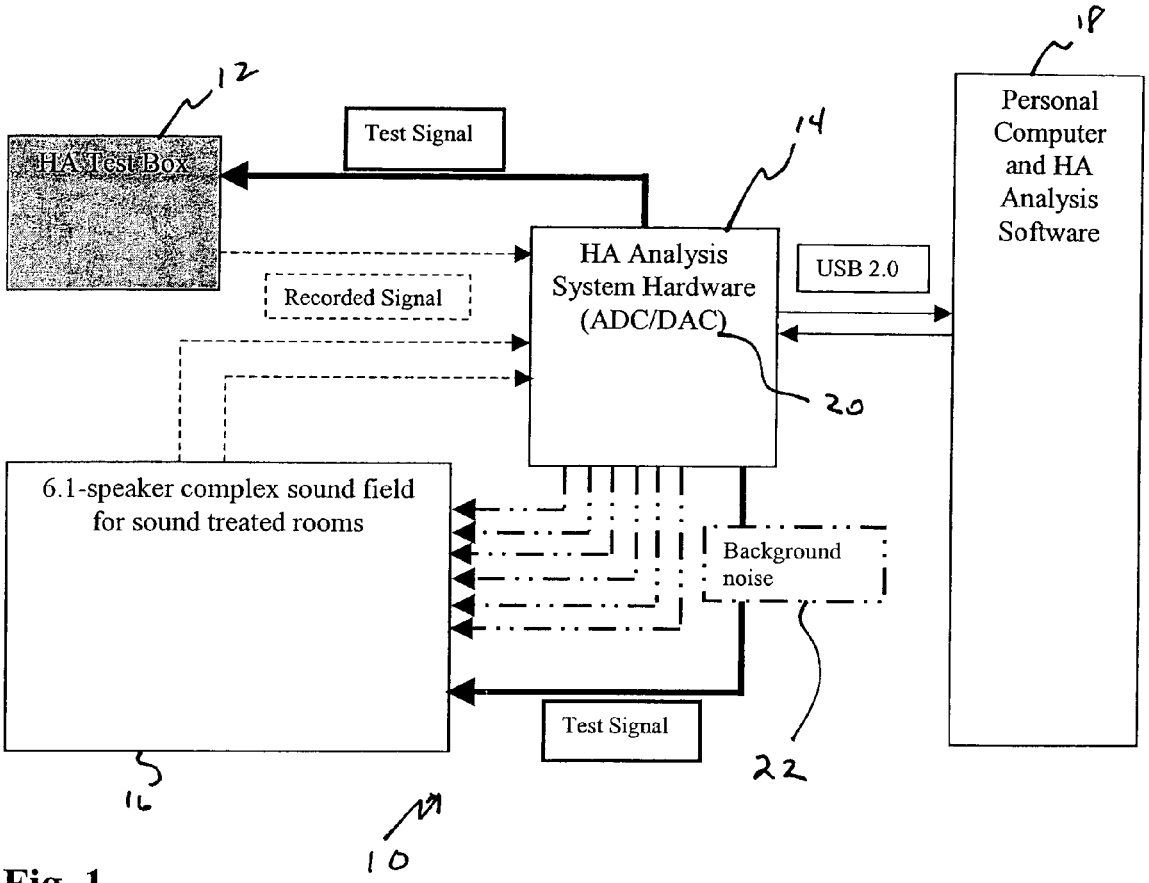
FIG. 1 is a block diagram depicting an overview of one embodiment of the hearing aid analysis system of the present invention.

While the present invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENTS

The present invention can be more readily understood by reference to FIGS. 1–7 and the following description. While the present invention is not necessarily limited to such applications, the invention will be better appreciated using a discussion of example embodiments in such a specific context.

Referring to FIG. 1, the hearing aid analysis system 10 of the invention generally includes test box 12, hearing aid analysis system hardware 14, 6.1 speaker complex sound room 16, and a personal computer with hearing aid analysis software 18.

Test box 12 is adapted to contain the hearing aid (not shown) under test and is further adapted to receive and broadcast a test signal generated by hearing aid analysis system hardware 14. Test box 12 is also adapted to receive sounds that have been processed through the hearing aid and return them in the form of a recorded signal to hearing aid analysis system hardware 14.

Hearing aid analysis system hardware 14 generally includes an analog to digital converter (ADC) and a digital to analog converter (DAC) 20. The analog to digital converter and digital to analog converter 20 preferably are included in a digital signal processing board (DSP). The hearing aid analysis system hardware 14 preferably also includes programmable attenuators 22. Programmable attenuators 22 are adapted to simulate background noise for testing purposes.

The 6.1 speaker complex sound room 16 includes a 6.1 surround sound system. This system includes a standard 5.1 surround system plus 1 back channel as well. The 6.1 speaker complex sound room 16 preferably includes a self calibrating 6.1 speaker sound field that is usable for testing directional microphone technology. The 6.1 utilizes a system in which sound directions are encoded not individual speaker inputs. Once this is done, well-defined mathematical relationships allow for relatively easy manipulation of spatial elements and apparent positioning of sound is similar on different speaker arrangements. Once the mathematical relationships are understood, it is also possible to combine recorded natural sounds with synthesized sounds or to create entirely synthetic sound environments. These systems have excellent sound reproduction in the center, but are less effective at the periphery. So, it is important that the hearing aid under test be located in the center area of maximum effectiveness.

The personal computer with hearing aid analysis software 18 is preferably connected to the hearing aid analysis system hardware 14 via a standard U.S.B. 2.0 connection. Any other appropriate data connection known to those having skill in the art may be utilized.

Figure 2:
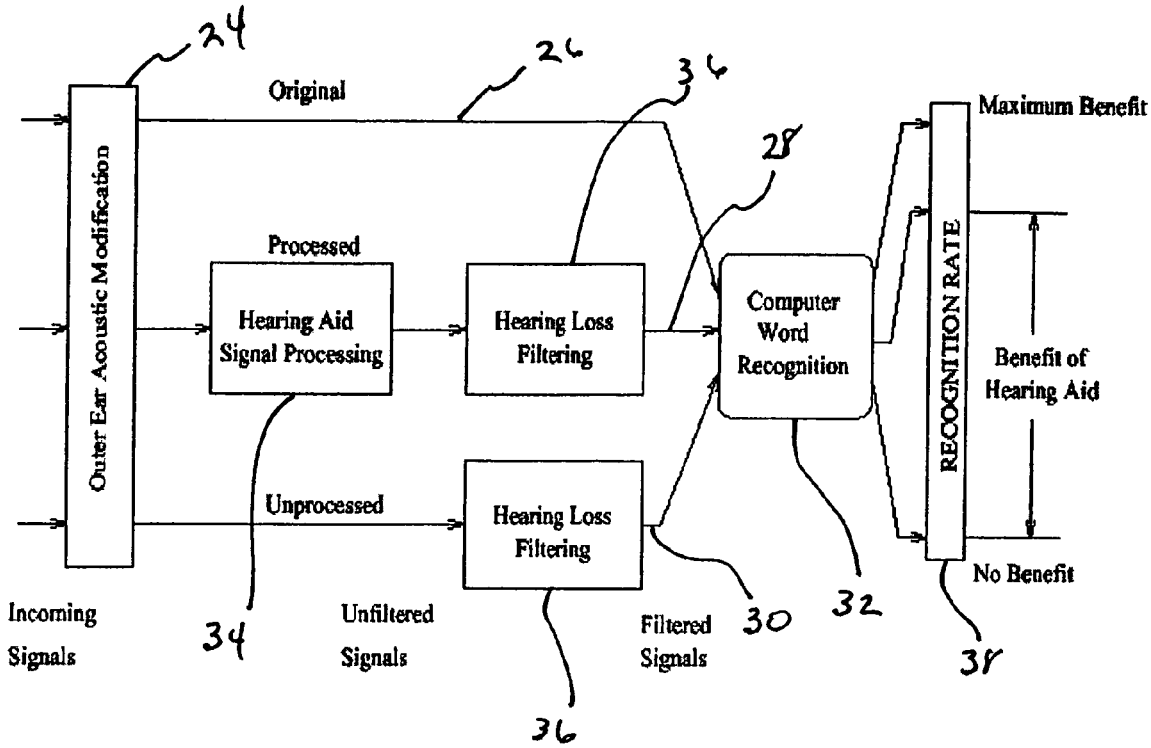
FIG. 2 is a block diagram depicting the processing of signals within the software utilized along with one embodiment of the present invention.

Referring to FIG. 2, the hearing aid analysis system hardware 14 can be broken up into two major components: 1) speech enhancement analysis; and 2) noise reduction analysis. Data acquisition may be either from data obtained from the test box 12 or from real ear analysis measures.

FIG. 2 is an example of speech enhancement analysis from real ear measures. All signals are subject to outer ear acoustic modification 24. Outer ear acoustic modification 24 includes those effects upon sound created by the structure of the pinna of the ear and physical structure of the patient. Preferably, such acoustic modification may be accomplished acoustically by physical structures. Alternatively, modification may be done electronically by filtering, or any combination thereof. This example of the software includes three paths, the original signal path 26, hearing aid processed signal path 28, and the hearing aid unprocessed signal path 30.

The original signal path 26 includes only passage through outer ear acoustic modification 24 which is then directed to a computer word recognition software program 32. The hearing aid processed path 28 includes hearing aid signal processing 34 followed by hearing aid loss filtering 36 which is then directed to computer word recognition software 32.

Hearing aid unprocessed path 30 passes through outer ear acoustic modification 24 and through hearing aid loss filtering 36 and then into computer word recognition software 32. Hearing aid loss filtering 36 preferably is simulated based on the latest physiology and psychoacoustic theory in order to simulate the hearing loss suffered by a given patient.

Computer word recognition software 32 is preferably a trained recognition system capable of evaluating the signal and providing the prediction of possible benefits obtainable from the hearing aid device under test. Recognition rate software 38 compares the original signal path 26 input with hearing aid processed signal path 28 input and hearing aid unprocessed path 30 input to determine a level of hearing aid benefit as compared to the maximum benefit that might be had.

A second division of the hearing aid analysis system software 18 considers the effect of both noise reduction strategies (such as signal filtering to reduce low frequency noise) and phase cancellation strategies (directional microphone systems).

Figure 3:
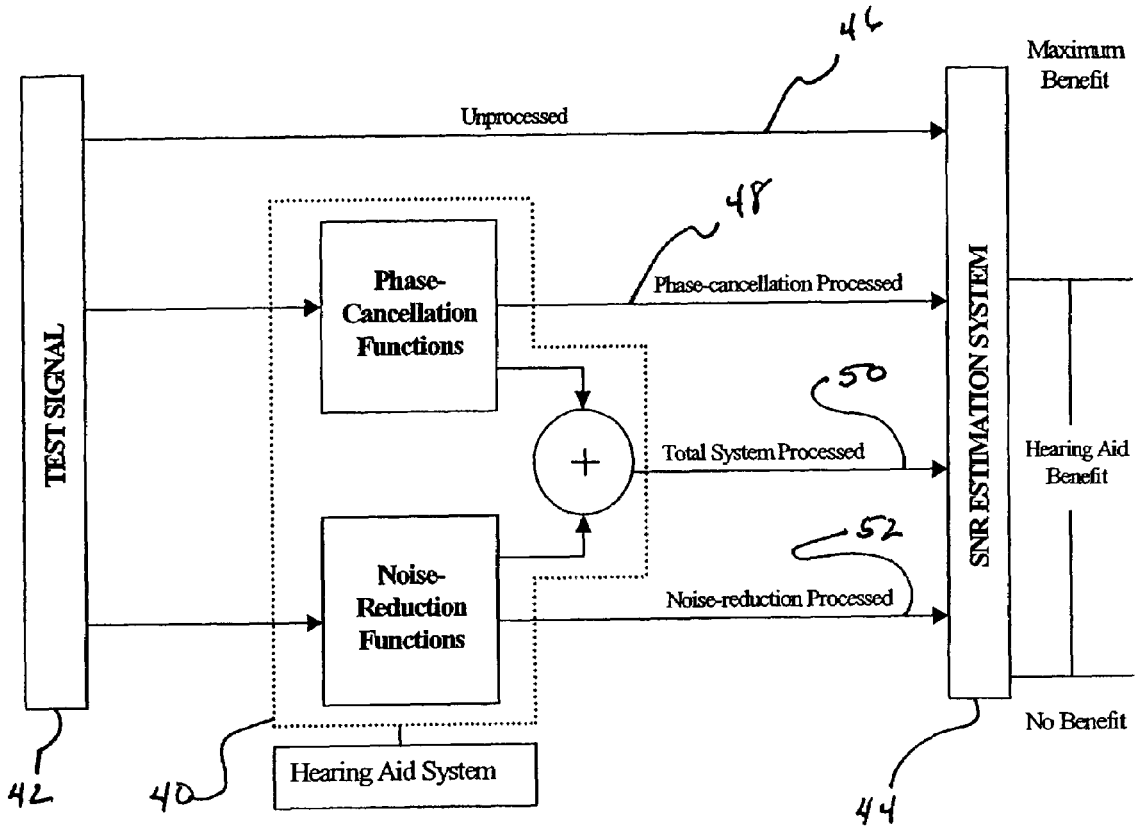
FIG. 3 is a block diagram depicting how the advanced signal processing strategies are evaluated, verified and validated by one embodiment of the present invention.

Referring to FIG. 3, a hearing aid under test 40 is interposed between test signal generator 42 and signal to noise ratio (SNR) estimation system 44. Several different inputs are directed to the SNR estimation system. Initially, an unprocessed test signal from test signal generator 42 is inputted to SNR estimation system 44. Thereafter, a phase cancellation process signal 48 is inputted to SNR estimation system 44. Similarly, a noise reduction processed signal 50 is inputted to SNR estimation system 44. Lastly, a combined processed signal 52 is inputted into SNR estimation system 44. The SNR estimation system 44 then compares the unprocessed signal 46, the phase cancellation process signal 48, noise reduction process signal 50 and combined processed signal 52 to estimate the relative benefits thereof.

The invention preferably also includes the use of a self-calibrating 6.1 speaker complex sound field 54. The 6.1 speaker complex sound field 54 is used to test directional microphone technology and to provide a realistic test of the hearing aid under test using real ear measures. The real ear measuring approach will help to account for acoustical modifications that are created by the unique features of the tested individual. For example, the structure of the head, pinna, and torso of an individual will affect the acoustical modification of sounds heard by that individual. For example, the signal to noise ratio benefit achieved by use of a directional microphone system is dependent upon the head size of the hearing aid user. Therefore, the benefit will vary significantly depending upon whether a given hearing aid is used by a child versus an adult.

The 6.1 speaker complex sound field 54 is self calibrating in that it uses the same microphone utilized for hearing aid data acquisition to dynamically adjust the sound field based upon the characteristics of the room that the sound filed 54 is operated in. Appropriate sound field adjustments and analysis are accomplished through the utilization of the hardware and software indicated above.

In operation, the hearing aid analysis system 10 is utilized initially to analyze the individual basic electrical acoustical components of the hearing aid. This step of the hearing aid analysis system 10 process is well known in the art. Next, the hearing aid under test while still located in test box 12, is supplied with a plurality of recorded test signals generated by the hearing aid analysis system hardware 14. Typically these test signals will include prerecorded speech. The speech test signals will initially be fed into computer word recognition software 32 unaltered. Next, the hearing aid will be interposed between the speech test signal and a recording device. Thus, the speech test signal will pass through the hearing aid signal processing 34 and through hearing aid loss filtering 36 before being fed into computer word recognition software 32. Then, the same speech signal will be fed into hearing loss filtering 36 and then into computer word recognition software 32. At this point, recognition rate software 38 will compare the rate of word recognition by computer word recognition software 32 to discern a level of benefit realized by use of the hearing aid in the system.

Next, noise reduction processing is tested. Initially a test signal from test signal generator 42 will be inputted unprocessed directly into SNR estimation system 44. Next, a test signal will be directed through the hearing aid with the noise reduction functions turned off. This will create a signal that has passed through only the hearing aid phase cancellation functions which will then be fed into SNR estimation system 44. Next, a test signal from test signal generator 42 will be passed through the hearing aid with only the noise reduction functions operating. This will result in a noise reduction processed signal 50 which is fed into SNR estimation system 44. Finally, a test signal will be directed through the hearing aid with both the phase cancellation functions and noise reduction functions activated, resulting in a combined processed signal that is inputted into SNR estimation system 44. SNR estimation system 44 then compares the various signals to discern an objective level of hearing aid benefit.

Programmable noise attenuators 22 are used to adjust and maintain the desired signal to noise ratio (SNR) of background noise and test signal. SNR typically is manipulated by one-third-octave analyses of the test signal along with a one-third-octave adjustment of the background noise level to maintain a desired SNR throughout the testing procedure. This procedure may be utilized to evaluate noise reduction algorithms in both the test box 12 environment and in real ear testing in the 6.1 speaker complex sound field 54.

The hearing aid is then tested using real ear measures in 6.1 speaker complex sound field 54. The hearing aid is inserted into the ear of a user along with a probe tube microphone which is inserted inside the ear canal of the user while the hearing aid is in place. The effectiveness of directional microphone technologies is then evaluated. This is accomplished while supplying a number of different directional signals through the 6.1 speaker complex sound field 54. The resulting measurements achieved through the use of the real ear testing can then be used to objectively evaluate the effectiveness of directional microphone technologies utilized in the hearing aid.

In the case of a fixed directional microphone system, simultaneous presentation of background noise signals from all six speakers is adequate. To properly evaluate adaptive directional microphone systems, both simultaneous and random individual presentation from the six speakers are desirable. The seventh speaker is used for presentation of the speech signal and is activated simultaneously with the six speakers presenting noise. A psychoacoustic-based measure then computes the resulting SNR.

Current technology provides a 3–5 decibel signal-to-noise ratio benefit. It is expected that evaluation of the noise reduction algorithm and directional microphone will demonstrate a further benefit beyond that level. A zero decibel change, of course, represents no benefit. Current research performance tests typically have a gross resolution of two decibels, at best. Resolution of the system herein disclosed is expected to be about one decibel.

A preferred embodiment of a computer-based speech recognition system for assessing the information-processing function of hearing aids was constructed in accordance with the preceding description. A vocabulary of 2007 words, derived from audiometric speech test material (e.g. digits, spondees (CID W-1), CID W-22, Isophonemic, PB-K, High Frequency word lists), was used. All 2007 vocabulary words were representative of both an adult male and female speaker of Midwestern dialect.

Figure 4:
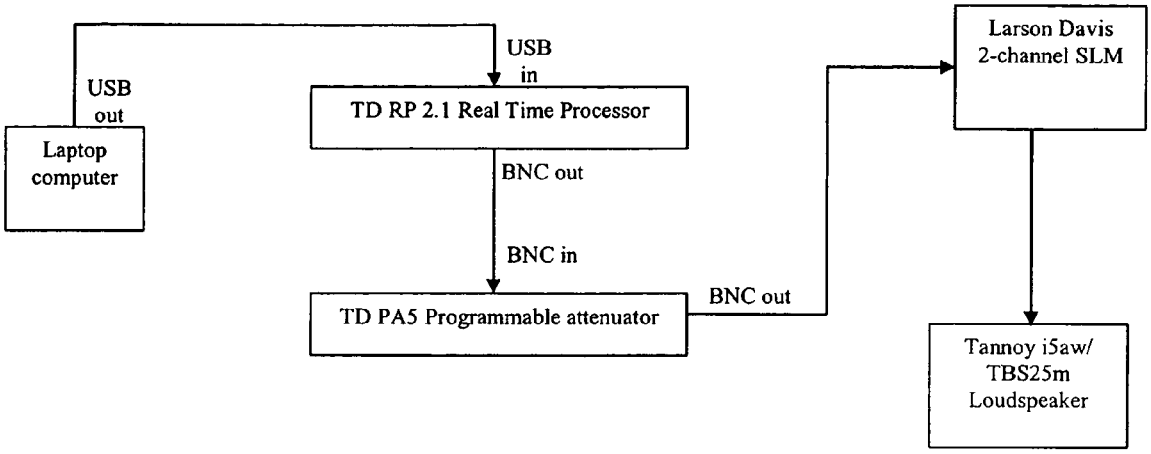
FIG. 4 is a block diagram depicting the presentation of speech signals in test box and anechoic environments in accordance with one embodiment of the present invention.
Figure 5:
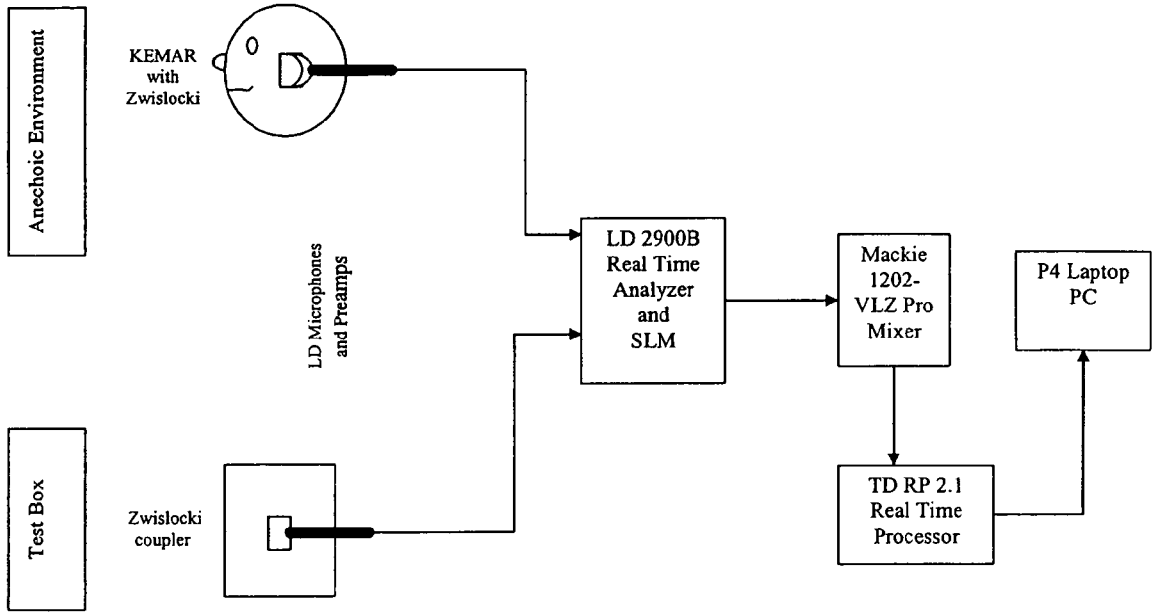
FIG. 5 is a block diagram depicting the recording of speech signals in test box and anechoic environments in accordance with one embodiment of the present invention.

Referring primarily to FIGS. 4 and 5, the 2007 vocabulary words were recorded in a test box setting and in an anechoic setting with a KEMAR. Unaided and aided (via three commercially available hearing aids) recordings were made in each setting. The presentation and recording stages involved complete control of the test signal to ensure optimal and uncorrupted results.

The testing of the speech recognition system was performed off-line using recordings from both test box and anechoic-KEMAR settings. Three different commercially available hearing aids were used. The first is a two-channel, seven-frequency-band-amplification system. It has two speech processing strategies to choose from. A second purports digital perception processing, adaptive and fixed directional patterns, and loudness mapping. All three are representative of non-linear processing and digital architecture. Software was provided with each hearing instrument to access the various programmable parameters available. All settings of hearing aids were set as prescribed by the manufacturer within the related software based on the NAL-RP fitting formula. The following two hearing loss configurations, as shown in TABLES 1 and 2, were programmed, independently, for each hearing aid test condition.

TABLE 1

| Mild-to-Moderate Hearing Loss | |
|---|---|
| 125 Hz | 30 dBHL |
| 250 Hz | 30 dBHL |
| 500 Hz | 30 dBHL |
| 1000 Hz | 35 dBHL |
| 2000 Hz | 40 dBHL |
| 4000 Hz | 45 dBHL |
| 8000 Hz | 50 dBHL |

TABLE 2

| Moderate-to-Severe Hearing Loss | |
|---|---|
| 125 Hz | 50 dBHL |
| 250 Hz | 50 dBHL |
| 500 Hz | 50 dBHL |
| 1000 Hz | 55 dBHL |
| 2000 Hz | 60 dBHL |
| 4000 Hz | 65 dBHL |
| 8000 Hz | 70 dBHL |

Thus, test conditions for the speech recognition system of the present invention included two test environments (test box, anechoic-KEMAR), two hearing impairments (mild, moderate), three presentation levels (55 dBA, 65 dBA, 75 dBA), and four recording conditions (three hearing aids, one unaided). Vocabulary used included 2007 words (digits, spondees, consonant-vowel, vowel-consonant, and consonant-vowel-consonant). Vocabulary words were presented in an adult male and adult female voice.

One embodiment of the speech recognition system built and tailored for assessing the information-processing function of hearing aids was tested according to the previously stated test conditions. The first test scenario concerned the unaided test condition in which recordings were taken without a hearing aid present. This test condition had the purpose of testing the assumption of whether the speech recognition engine had a recognition error rate of 3% or less. Upon testing the speech recognition with 12 datasets (3 presentation levels×2 environments×2 talkers), each consisting of 2007 words, the recognition error rate was found to be 0%.

Figure 6:
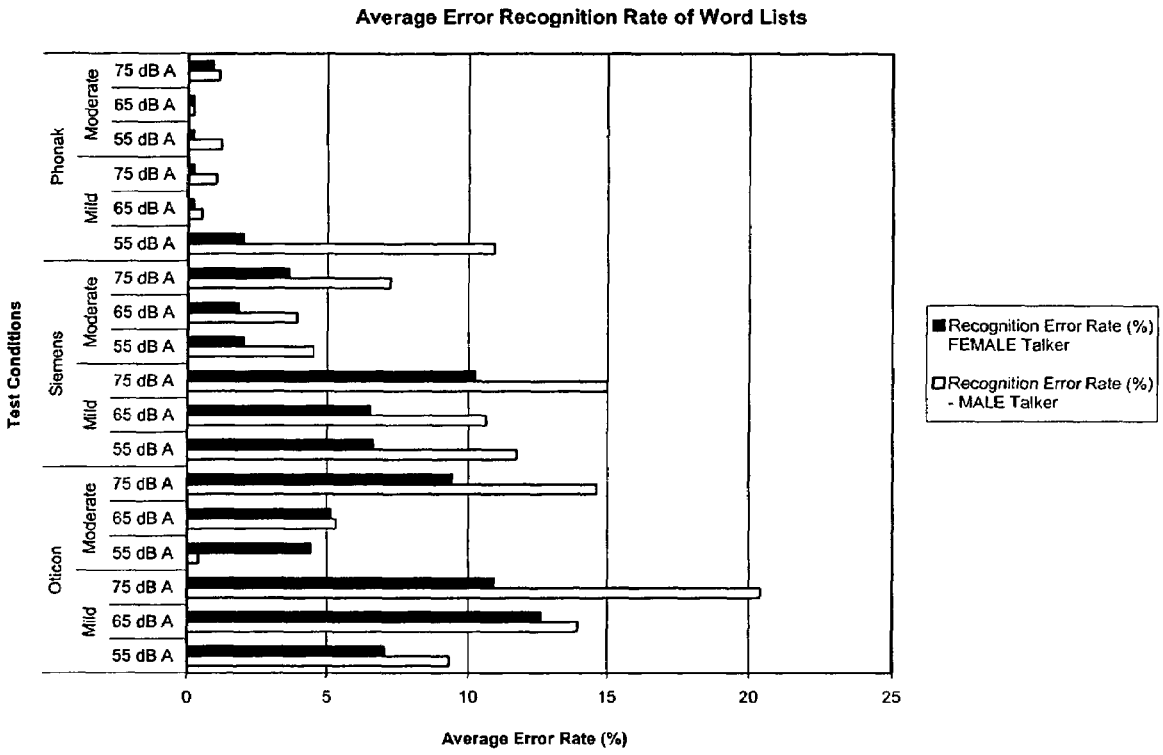
FIG. 6 is a graph of experimental average recognition error rates produced by one embodiment of the hearing aid analysis system of the present invention.
Figure 7:
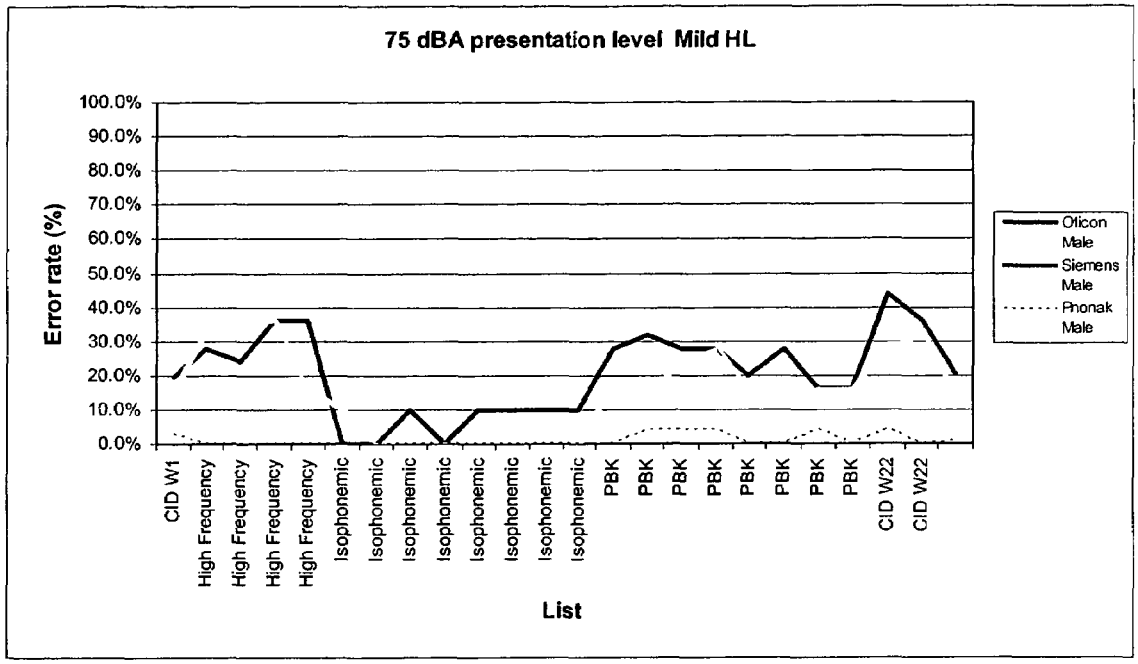
FIG. 7 is a graph of experimental percentage error recognition rates for individual word lists across individual hearing aids programmed for a mild-moderate hearing impairment in accordance with one embodiment of the present invention.

The second test scenario concerned the aided test condition in which recordings were taken with a hearing aid present. This test condition had the purpose of testing the assumption of whether the hearing aid's signal processing design altered the speech signal in a measurable way. A total of 72 datasets (3 presentation levels×2 environments×3 hearing aids×2 hearing loss configurations×2 talkers), each consisting of 2007 words, was recorded and presented to the speech recognition engine. FIG. 6 summarizes these results, averaged across the multiple word lists. Here, one can observe that a difference exists across hearing aids. For instance, the recognition error rate average across all test conditions albeit the hearing aid condition is 9.4%, 7%, and 1.6% for the three hearing aids, respectively. Within each hearing aid condition, one can observe greater recognition error rates for particular word lists, presentation levels, and/or hearing impairment. On average, recognition error rates appear greater for male spoken words than female spoken words. Also, recognition error rates appear greater for higher presentation levels than lower presentation levels for two out of the three hearing aids. Examining individual test conditions, isophonemic and digit word lists produced the least amount of recognition rate errors whereas the high frequency word lists produced the greatest amount of recognition rate error. Interestingly, for high frequency word lists, more intense presentation levels (e.g., 75 dBA) produced more recognition rate error than less intense presentation levels. FIG. 7 provides a sample condition of this event.

Confusion matrices were also constructed to find if there were particular words or phonemic content that produced greater recognition error in the speech recognition system. It was found that words containing sibilants in the final position (e.g., [s]) produced greater recognition rate error than other high frequency consonants (e.g., /it/ versus /its/). This was observed for both male and female talker lists.

The present invention has developed an instrument-based method of assessing the information-processing function of hearing aids. Recognition rate error for unprocessed vocabulary of 2007 words was 0%. The intrinsic variations of speech did not appear to affect recognition performance. Noise floor conditions were no worse than 10 dB across test conditions and, according to a 15 dB or greater signal-to-noise ratio criteria, the speech recognition engine performed optimally. Analysis of three commercially available hearing aids with digital signal processing platforms revealed differences between each in terms of the recognition rate error. These differences may relate to the compression characteristics or other speech enhancement algorithms adopted by each of the respective hearing aids. For example, one of the hearing aids is more linear in its processing strategies than the other two hearing aids. This may attribute to its lower recognition error rates as compared with the other hearing aids. In other words, the more linear the system, the less chance of reducing the dynamic range of the test signal, namely speech. By maintaining the dynamic range of speech, less spectral content of the speech signal may be lost. These data developed by the testing performed on the system of the present invention appear to support this hypothesis.

While the preferred embodiment of the present invention has been described and tested with respect to speech recognition for the English language, it will be recognized that the present invention is equally applicable to speech recognition in other languages. Given the phonetic, timing and tonal differences of different languages, the present invention may also be utilized to identify hearing aids that are better suited for particular languages based on speech recognition in that language. Similarly, the present invention can not only be used to differentiate the response of different hearing aids, but can also be utilized to evaluate and adjust a single hearing aid for a particular patient in terms of programmable parameters and setting adjustments for that hearing aid.

While the preferred embodiment has been described with respect to particular circuitry and hardware or software combinations, it will be recognized and understood that circuitry can be implemented in any number of discrete or integrated embodiments, including ASICs, FPGAs, PLAs and microcontrollers or state machines with embedded firmware. Alternatively, the operation of the circuitry could be implemented or emulated in software running on a computer, or a combination of circuitry and hardware and software. Similarly, both the speech recognition program and the control program executing on a computer system used as part of this invention may also be implemented in any combination of software, hardware and/or circuitry. The software for the speech recognition program may be a commercially available speech recognition package or may be integrated as custom software with the control program.

Although the present invention has been described with reference to particular embodiments, one skilled in the art will recognize that changes may be made in form and detail without departing from the spirit and the scope of the invention. Therefore, the illustrated embodiments should be considered in all respects as illustrative and not restrictive.

What is claimed is:

1. A hearing aid analysis system comprising:

a source of prerecorded speech sounds;

hearing aid analysis circuitry, including:

circuitry to receive a plurality of signals representing signals generated by speech sounds routed through different acoustic paths, and filter circuitry to selectively simulate a hearing loss;

a hearing aid under test operably interfaced with the source of prerecorded speech sounds and the hearing aid analysis circuitry; and a computer system operably connected to die hearing aid analysis circuitry and the source of prerecorded speech sounds, the computer system including:

a control program that operates to present the prerecorded speech sounds to the hearing aid analysis circuitry to produce a first degraded signal routed through the filter circuitry and a second processed signal routed through the hearing aid and the filter circuitry; and a speech recognition program that compares speech recognition from the first degraded signal and speech recognition from the second processed signal to determine an objective indication of speech perception enhancement for the hearing aid under test.

2. The hearing aid analysis system of claim 1, wherein the control program operates to present the prerecorded speech sounds to produce a control unprocessed signal that is not routed through the filter circuitry or the hearing aid, the control unprocessed signal being used by the speech recognition program as a control for optimal speech recognition for the prerecorded speech sounds such that the objective indication of speech perception enhancement is expressed in relation to the control.

3. The hearing aid analysis system of claim 1, wherein the hearing aid analysis circuitry includes:

an analog to digital converter;

a digital to analog convener; and a digital signal processor.

4. The hearing aid analysis system of claim 3, wherein the hearing aid analysis circuitry further includes programmable attenuators.

5. The hearing aid analysis system of claim 1, further comprising a multiple speaker arrangement operably connected to the hearing aid analysis system and acoustically coupled to the hearing aid under test such that the control program operates to present prerecorded speech sounds though different combinations of speakers in the multiple speaker arrangement to permit evaluation of directional microphone capabilities of the heating aid under test.

6. The hearing aid analysis system of claim 5, wherein the multiple speaker arrangement is a 6.1 speaker complex sound field.

7. The hearing aid analysis system of claim 1, further comprising an outer ear acoustic modification through which the prerecorded speech sounds are acoustically routed.

8. The hearing aid analysis system of claim 7, wherein the hearing aid is tested in position in a user such that the outer ear acoustic modification is the physical structure of the user and the hearing aid analysis circuitry further includes a probe tube microphone inserted in an ear canal of the user.

9. The hearing aid analysis system of claim 1, wherein the filter circuitry selectively simulates a hearing loss based on the latest physiology and psychoacoustic theory in order to simulate the hearing loss suffered by a given patient.

10. The hearing aid analysis system of claim 1, wherein the hearing aid analysis circuitry further includes signal-to-noise analysis circuitry that estimates signal-to-noise ratio (SNR) of the hearing aid under test to a plurality of different test signals under control of the computer system and the computer system compares SNR for the plurality of test signals to provide an additional objective determination of the benefit of the hearing aid under test.

11. The hearing aid analysis system of claim 10, wherein the hearing aid analysis circuitry further includes a test signal generator to generate the plurality of different test signals and the hearing aid analysis circuitry analyzes the different test signals routed through the hearing aid under test for a signal without phase cancellation or noise reduction, a phase cancellation only signal, a noise reduction only signal and a combination of phase cancellation and noise reduction signals.

12. A method of testing the effectiveness of a hearing aid under test using a hearing aid analysis system, comprising the steps of:

interfacing the hearing aid under test with a source of prerecorded speech sounds and with hearing aid analysis circuitry including filter circuitry;

presenting the prerecorded speech sounds to the hearing aid analysis circuitry;

producing a first degraded signal muted through the filter circuitry;

producing a second processed signal routed through the hearing aid and the filter circuitry;

comparing speech recognition from the first degraded signal and speech recognition from the second processed signal using a speech recognition program; and determining an objective indication of speech perception enhancement for the hearing aid under test.

13. The method of claim 12, further comprising:

presenting the prerecorded speech sounds to produce a control unprocessed signal that is not routed through the filter circuitry or the hearing aid; and using the control unprocessed signal in the speech recognition program as a control for optimal speech recognition for the prerecorded speech sounds such that the objective indication of speech perception enhancement is expressed in relation to the control.

14. The method of claim 12, further comprising:

connecting a multiple speaker arrangement to the hearing aid analysis system and acoustically coupling the multiple speaker arrangement to the hearing aid under test;

presenting prerecorded speech sounds through different combinations of speakers in the multiple speaker arrangement; and evaluating directional microphone capabilities of the hearing aid under test.

15. The method of claim 14, wherein the step of connecting a multiple speaker arrangement to the hearing aid analysis system further comprises connecting a 6.1 speaker complex sound field to the hearing aid analysis system and acoustically coupling the 6.1 speaker complex sound field to the hearing aid under test.

16. The method of claim 12, further comprising:

acoustically routing the prerecorded speech sounds through an outer ear acoustic modification.

17. The method of claim 16, further comprising:

inserting a probe tube microphone into the ear canal of a user; and testing the hearing aid in position in the user such that the outer ear acoustic modification is the physical structure of the user.

18. The method of claim 12, further comprising:

selectively simulating a hearing loss based on the latest physiology and psychoacoustic theory in the filter circuitry to simulate the hearing loss suffered by a given patient.

19. The method of claim 12, further comprising:

estimating a signal-to-noise ratio (SNR) of the hearing aid under test to a plurality of different test signals; and comparing the SNR for the plurality of test signals to provide an additional objective determination of the benefit of the hearing aid under test.

20. The method of claim 19, further comprising:

generating a plurality of different rest signals using a test signal generator; and analyzing the different test signals routed through the hearing aid under test for a signal without phase cancellation or noise reduction, a phase cancellation only signal, a noise reduction only signal, and a combination of phase cancellation and noise reduction signals.

* * * * *